US007266865B1

(12) United States Patent
Rodin

(10) Patent No.: US 7,266,865 B1
(45) Date of Patent: Sep. 11, 2007

(54) COMBINATION NAPKIN CLIP AND UTENSIL REST

(76) Inventor: John B. Rodin, 13119 Woodcrest La., Chesterland, OH (US) 44026

( * ) Notice: Subject to any disclaimer, the term of this patent is extended or adjusted under 35 U.S.C. 154(b) by 8 days.

(21) Appl. No.: 11/231,279

(22) Filed: Sep. 20, 2005

(51) Int. Cl.
*A44B 21/00* (2006.01)
*A47G 21/14* (2006.01)
*A45F 5/04* (2006.01)

(52) U.S. Cl. ..... 24/530; 248/175; 248/37.3; 24/7; 24/3.12

(58) Field of Classification Search ..... 24/530, 24/DIG. 8, DIG. 9, DIG. 10, DIG. 28, 198, 24/200, 169, 67.9, 129 C, 131 R, 545, 533, 24/546, 4, 3.13; 248/175, 37.3
See application file for complete search history.

(56) References Cited

U.S. PATENT DOCUMENTS

| | | | | | |
|---|---|---|---|---|---|
| 473,094 | A | * | 4/1892 | Stahley | 24/169 |
| 739,668 | A | * | 9/1903 | Gooding | 24/545 |
| 1,400,178 | A | * | 12/1921 | Perrine | 24/200 |
| 1,647,154 | A | | 11/1927 | Soybel | |
| 1,675,040 | A | * | 6/1928 | Mix | 24/198 |
| 1,753,878 | A | | 4/1930 | Burnham | |
| 1,886,075 | A | | 11/1932 | Zorsch | |
| 1,898,741 | A | * | 2/1933 | Peterson | 24/200 |
| 2,020,507 | A | * | 11/1935 | Keys | 24/198 |
| D156,659 | S | | 12/1949 | Reed | |
| D156,958 | S | | 1/1950 | Hoeft | |
| D164,647 | S | | 9/1951 | Murray | |
| 2,639,081 | A | | 5/1953 | Metzger | |
| 2,651,927 | A | | 9/1953 | Mullins | |
| 2,901,197 | A | | 8/1959 | Posey | |
| D187,024 | S | | 1/1960 | Bryant | |
| D191,592 | S | | 10/1961 | Wolf et al. | |
| 3,026,076 | A | | 3/1962 | Bender | |
| 3,189,250 | A | * | 6/1965 | Haygeman | 24/546 |
| 3,239,177 | A | | 3/1966 | Samsing | |
| 3,673,641 | A | * | 7/1972 | Lorber | 24/545 |
| 3,848,943 | A | | 11/1974 | Geesaman et al. | |
| 3,915,213 | A | | 10/1975 | Graham | |
| D237,447 | S | | 11/1975 | Ashton | |
| D244,340 | S | | 5/1977 | Ashton | |
| D255,083 | S | | 5/1980 | Kott | |
| D255,311 | S | | 6/1980 | Dunne | |
| D270,511 | S | | 9/1983 | Friedman | |
| D276,206 | S | | 11/1984 | Williams | |
| 4,528,800 | A | * | 7/1985 | Burns | 24/570 |
| D285,517 | S | | 9/1986 | Paulus | |
| D292,861 | S | | 11/1987 | Dorper | |
| 4,800,108 | A | | 1/1989 | Swartz | |
| 4,834,328 | A | | 5/1989 | Hall | |
| 4,858,863 | A | | 8/1989 | Lin | |
| 4,893,768 | A | | 1/1990 | Hall | |
| 4,918,789 | A | * | 4/1990 | Chen et al. | 24/546 |
| 4,940,199 | A | | 7/1990 | Hall | |
| 5,011,017 | A | | 4/1991 | Giesen | |
| D326,591 | S | | 6/1992 | Hall | |

(Continued)

*Primary Examiner*—Robert J. Sandy
(74) *Attorney, Agent, or Firm*—Pearne & Gordon LLP

(57) ABSTRACT

A device which functions as a rest for a knife, fork and spoon and also functions as a clip for a rolled up napkin with utensils therein.

15 Claims, 10 Drawing Sheets

U.S. PATENT DOCUMENTS

| | | | |
|---|---|---|---|
| 5,191,681 | A | 3/1993 | Lokken |
| 5,411,141 | A | 5/1995 | Bounds |
| 5,487,924 | A | 1/1996 | Fritze |
| D367,405 | S | 2/1996 | Bridger |
| D378,564 | S | 3/1997 | Hall |
| 5,755,413 | A | 5/1998 | Press |
| 5,785,238 | A | 7/1998 | Tai |
| D419,395 | S | 1/2000 | Swanson |
| D444,356 | S | 7/2001 | Conaway |
| D446,424 | S | 8/2001 | Hall |
| 6,449,807 | B1 | 9/2002 | Langkammerer |
| 6,604,714 | B1 | 8/2003 | Hall |

* cited by examiner

COMBINATION NAPKIN CLIP AND UTENSIL REST

BACKGROUND OF THE INVENTION

1. Field of Invention

The present invention relates to a support for eating utensils and a clip for rolled up napkins with utensils.

2. Description of Related Art

Common practice in countless restaurants and homes is to allow eating utensils, such as knife, fork and spoon, to make direct contact with the table top before or during a meal. Such practice can be unsanitary, since table tops particularly in restaurants often breed bacteria and can be unclean, since used utensils can soil a table top unnecessarily. As a result, many efforts have been made to provide the perfect utensil support; however, since none has become prevalent in society, each one has failed in some fashion to solve this problem. In addition, table napkins, particularly cloth napkins, can easily become unrolled. There is a need for a clip that can easily and conveniently hold a napkin in a rolled or folded condition. Accordingly there is a need for an apparatus which combines a napkin clip and utensil rest in a single device.

SUMMARY OF THE INVENTION

A device for use as a napkin clip and utensil rest is provided. The device comprises a base having a longitudinal axis and an upper arm having a longitudinal axis. The base has a bottom which substantially defines a claim so that the bottom is capable of being rested on a flat surface. The upper arm has a distal end and a proximal end; the proximal end is joined to the base by a bridge portion. The upper arm is substantially parallel with the plane. The longitudinal axis of the base is substantially parallel with the longitudinal axis of the upper arm. The base and upper arm define a gap therebetween effective to accommodate a napkin.

DETAILED DESCRIPTION OF THE PREFERRED EMBODIMENTS OF THE INVENTION

When a range such as 5-25 or 5 to 25 is given, this means preferably at least 5 and, separately and independently, preferably not more than 25.

The present invention is directed to a combination utensil support and napkin clip. The invented utensil support/napkin clip provides a method of supporting eating utensils in order to keep them off table tops where they can be easily contaminated. This also helps keep the table top itself clean, while eliminating or reducing the need for placemats, table covers, or additional napkins. The utensil support/napkin clip also provides a method of clipping a napkin with eating utensils rolled up inside. This creates a simple, logical, and aesthetically pleasing package for table settings. In addition, the invented utensil support/napkin clip provides a method of supporting eating utensils while placing a napkin within for easy removal and replacement without moving the eating utensils. This design creates a simple option for using paper napkins instead of cloth, as well as opening up various possibilities for incorporating a cloth napkin in the table setting. Lastly, an embodiment of the invention can function as a bib clip.

Figure 1:
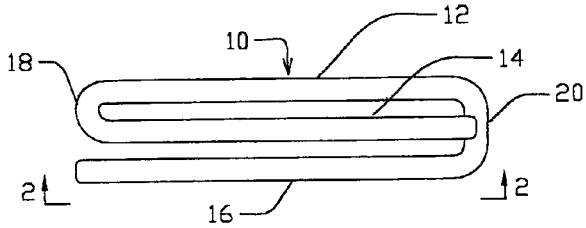
FIG. 1 is a top or plan view of a device according to the invention.
Figure 3:
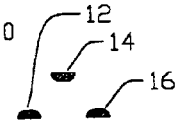
FIG. 3 is a cross-sectional view taken along line 3-3 of FIG. 2.
Figure 2:
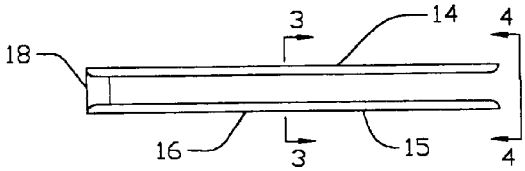
FIG. 2 is a front or elevational view of the device of FIG. 1 taken along line 2-2 of FIG. 1.
Figure 4:
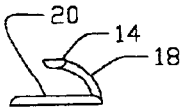
FIG. 4 is an end view taken along line 4-4 of FIG. 2.

With reference to FIGS. 1-4, FIG. 1 shows the invented device or clip 10, which is a combination utensil rest or support and napkin clip. Device 10 comprises an upper arm 14, a bridge portion 18, and a base. The base is comprised of free leg 16, connected leg 12, and base leg connector 20. The base is connected to the upper arm 14 by the bridge portion 18. With reference to FIG. 2, a bottom surface or plane 15 is shown, which is the bottom surface of leg 16 and the bottom surface of leg 12 which together define a plane; that is; the bottom surface of leg 16 and the bottom surface of leg 12 form or define a plane so that device 10 can preferably rest on a flat table top or surface without wobbling. Device 10 can be made of metal or wood or other material, preferably plastic. Bridge portion 18 elevates upper arm 14 above the base to support and elevate the eating utensils above the table top while providing a slot or gap so the device 10 can be used as a napkin clip. Elements 14, 16 and 12 are preferably substantially parallel. When viewed from the top as in FIG. 1 upper arm 14 is preferably between (preferably centered between) the front of leg 16 and the back of leg 12 so that device 10 will be stable and will not tip over when utensils are supported on arm 14. Bridge portion 18 is shown as an arc connecting arm 14 with leg 12. The proximal end of arm 14 joins bridge portion 18; the distal end of arm 14 is free.

Figure 5:
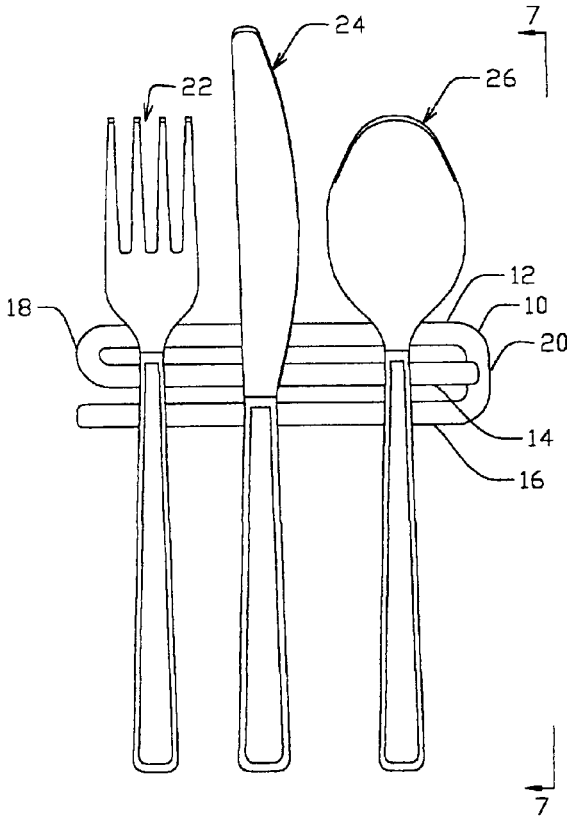
FIG. 5 is a top or plan view of the device of FIG. 1 being used as a utensil support, in particular for a fork, knife, and spoon.
Figure 6:
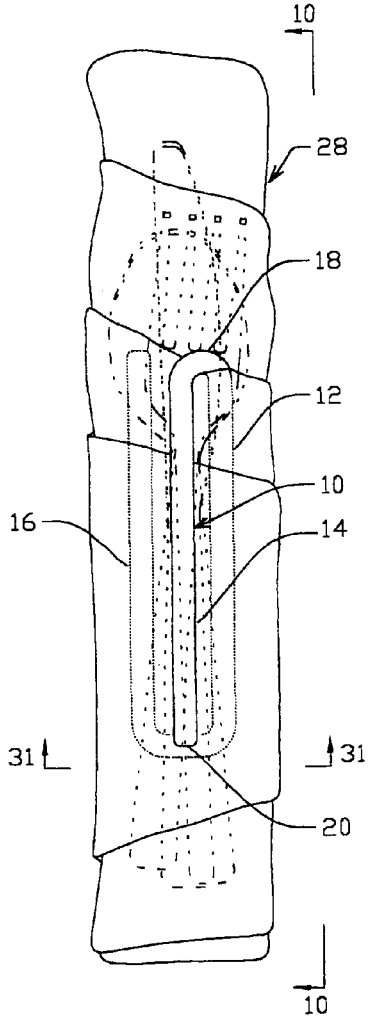
FIG. 6 is a top or plan view of the device of FIG. 1 being used as a napkin clip with eating utensils rolled up in a cloth napkin.

FIG. 5 shows a plan view of the device 10 being used as a utensil rest supporting eating utensils (in this case a fork 22, knife 24, and spoon 26 respectively, however, could also include chopsticks, toothpicks, and the like). FIG. 6 shows a plan view of device 10 being used as a cloth napkin clip with the aforementioned eating utensils rolled up inside the napkin 28.

Figure 7:
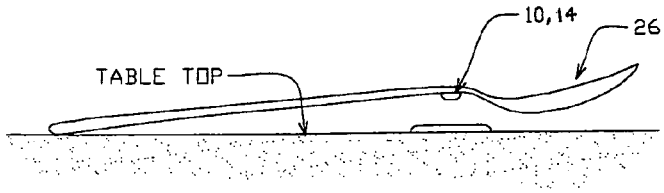
FIG. 7 is a side view taken along line 7-7 of FIG. 5, but with the knife and fork omitted.

FIG. 7 shows a side view of FIG. 5 taken along lines 7-7 but without the knife and fork. The utensils are represented by the spoon in order to show their position in relation to device 10 and the table top. Notice that only the bottom handles of the eating utensils come in direct contact with the table top, while the parts that make contact with the human mouth are elevated above the table top.

Figure 9:
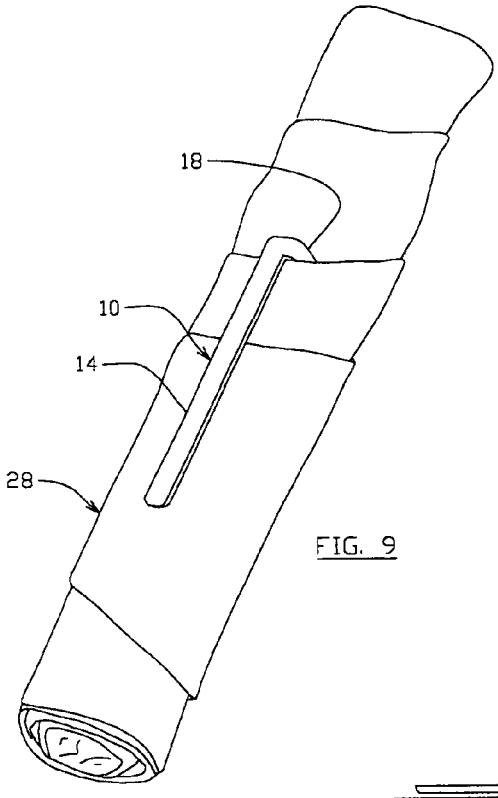
FIG. 9 is a perspective view of FIG. 6.
Figure 8:
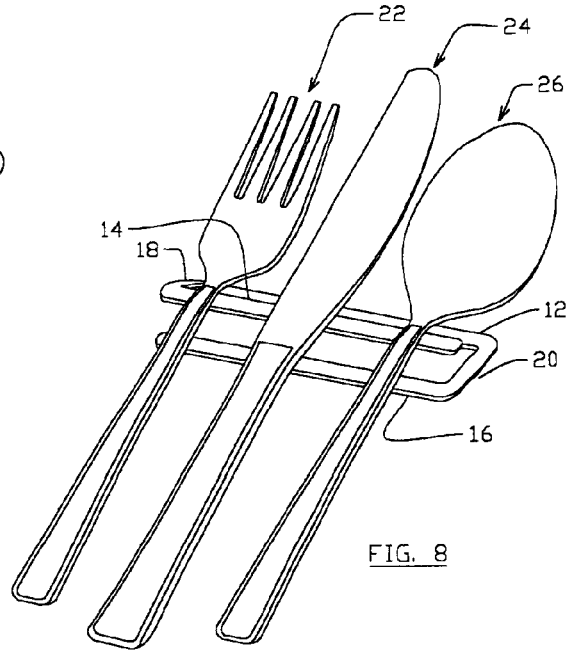
FIG. 8 is a perspective view of the device and utensils of FIG. 5.
Figure 10:
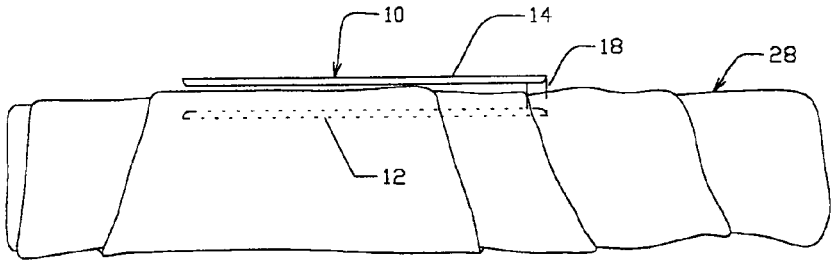
FIG. 10 is a side view taken along line 10-10 of FIG. 6.

FIG. 8 shows a 3-dimensional view of FIG. 5. FIGS. 9-10 show the device 10 in use as a cloth napkin clip.

Figure 11:
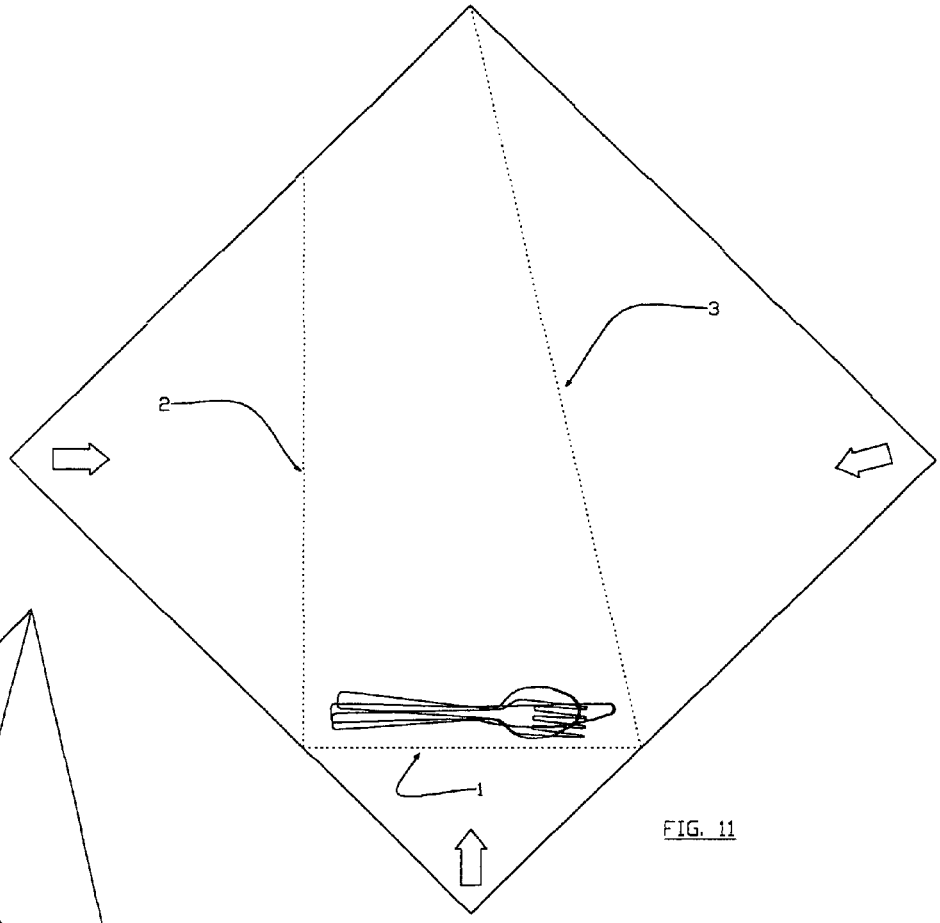
FIG. 11 is a top or plan view illustrating a common technique for preparing eating utensils to be rolled in a cloth napkin.
Figure 12:
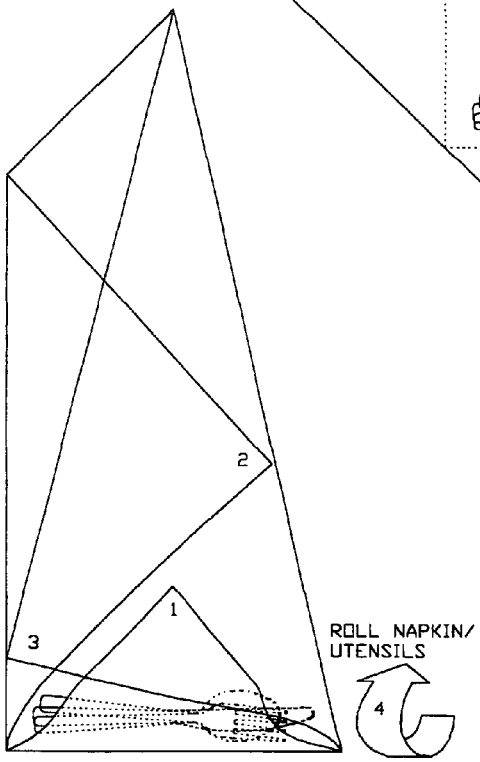
FIG. 12 is a top or plan view illustrating a common technique for rolling eating utensils in a cloth napkin.
Figure 13A:
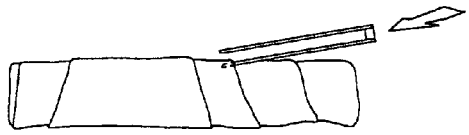
FIGS. 13*a* and 13*b* show FIG. 10 as the napkin clip is inserted into the napkin roll.
Figure 13B:
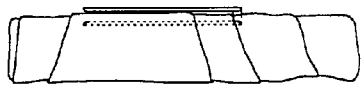

In order to describe FIG. 6, a common technique is shown in FIGS. 11 and 12 to roll eating utensils inside a cloth napkin. FIG. 11 shows the eating utensils placed on the napkin and the folding lines 1 through 3 made prior to rolling the utensils up inside the napkin (FIG. 12). The bundle is then rolled up as shown at 4 in FIG. 12. The result is a tightly bound set of eating utensils inside a napkin roll as shown in FIG. 6 and FIGS. 13*a* and 13*b*—the arrow in FIG. 13*a* indicates the direction the device 10 takes in order for elements 12, 20, and 16 to be inserted inside the napkin roll's layers and, thus, hidden from view. This leaves only upper arm 14 and part of element 18 in view and on display (as shown 3-dimensionally in FIG. 9). In order for this to be done easily, leg 20 is shown to have rounded corners and smooth lines. Preferably all corners are rounded and all lines are smooth. This helps prevent any snags and enables device 10 to be inserted smoothly and consistently, after which the roll becomes even tighter, while arm 14 helps prevent the end of the napkin from unrolling. Arm 14 is also kept in plain view of the patron who can easily use two fingers to grab any portion of elements 18 and 14 and slip device 10 out of the napkin roll and onto the table top so that elements 12, 20, and 16 are resting on the table approximately parallel with the shoulder lines of the patron, and to the patron's right hand side, preferably where eating utensils would normally be located if they were placed on the patron's right hand side of the dinner plate. As the napkin is unrolled, the utensils are removed and placed onto the awaiting device 10 (as shown in FIGS. 5 and 8), while the cloth napkin is customarily placed on the patron's lap. The utensils can be removed before the napkin is unrolled if the napkin is folded in such a way as to have either part of the handles or the opposite ends exposed within the roll. In such a way, the utensils can be removed and placed on device 10 before the napkin is unrolled. From their position on device 10, the utensils can be removed and replaced during the course of the meal, without making direct contact with the surface of the table, thereby promoting good hygiene and environmental awareness: the utensils and table top stay clean, and no additional napkins, placemats, or table cloths are required.

Figure 14:
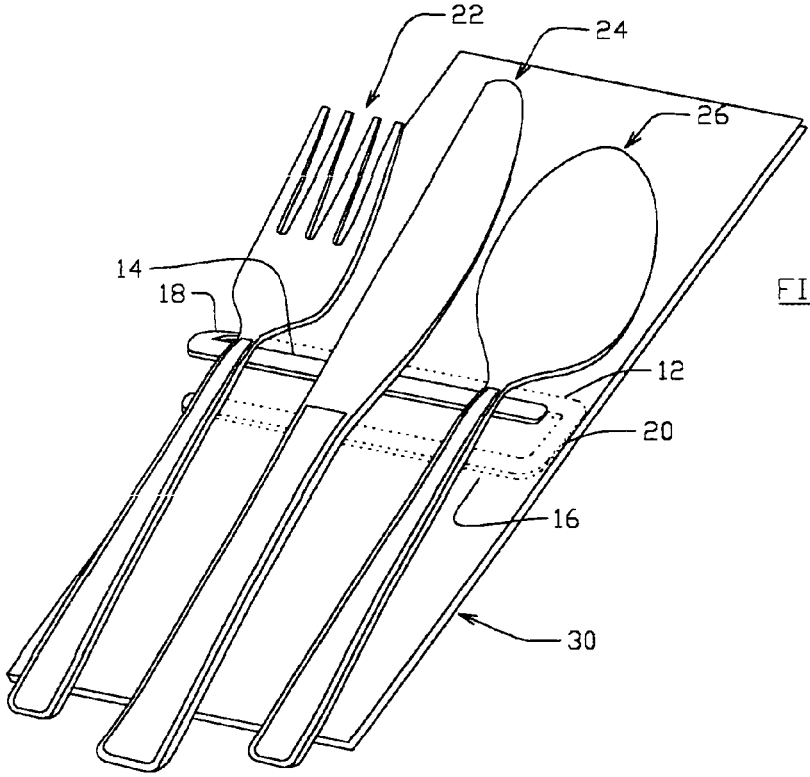
FIG. 14 is a perspective view of a device according to the invention being used as a utensil rest and a device into which a napkin can be placed in a table setting so that it can be removed and replaced without moving the eating utensils.
Figure 15:
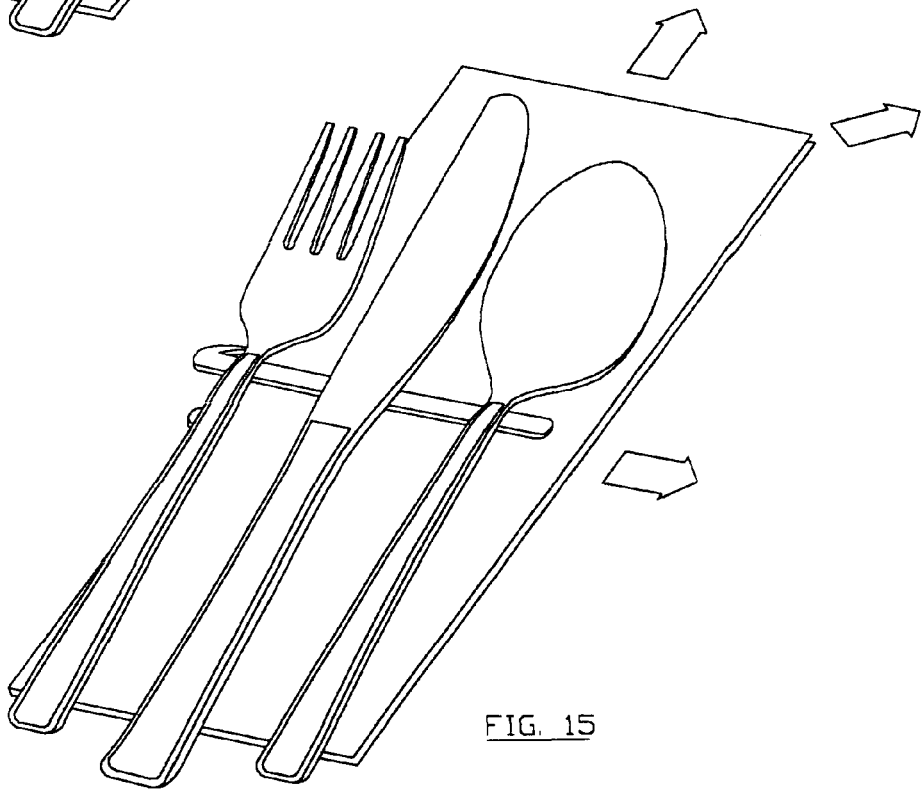
FIG. 15 shows FIG. 14 without the hidden lines.

FIG. 14 shows an example of clip 10 being used with a paper napkin 30. In such a setting, clip 10 has the ability to support eating utensils while creating a space or gap into which a paper napkin can be inserted for easy removal and replacement without moving the eating utensils. Only elements 18 and 14 are in view (FIG. 15), with arm 14 being in plain view so that the eating utensils seem to be floating above the napkin. This enables the napkin to be used throughout the course of the meal or placed on the lap of the patron without moving or disturbing the setting of the eating utensils. A cloth napkin may also be used in the same manner to achieve a unique table setting while allowing the napkin to be removed out from under the eating utensils (in one of the directions represented by the arrows) while, again, not moving or disturbing the location of the utensils.

Figure 16:
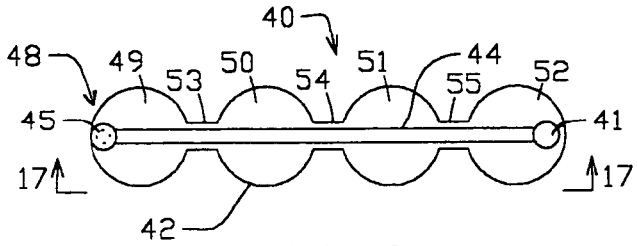
FIG. 16 is a top or plan view of another embodiment of the invention.
Figure 18:
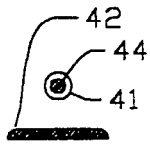
FIG. 18 is a cross-sectional view taken along line 18-18 of FIG. 17.
Figure 17:
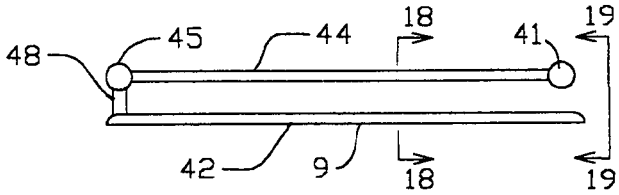
FIG. 17 is a front or elevational view of the device of FIG. 16 taken along line 17-17 of FIG. 16.
Figure 19:
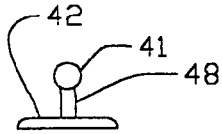
FIG. 19 is an end view of the device of FIG. 17 taken along line 19-19 of FIG. 17.
Figure 20:
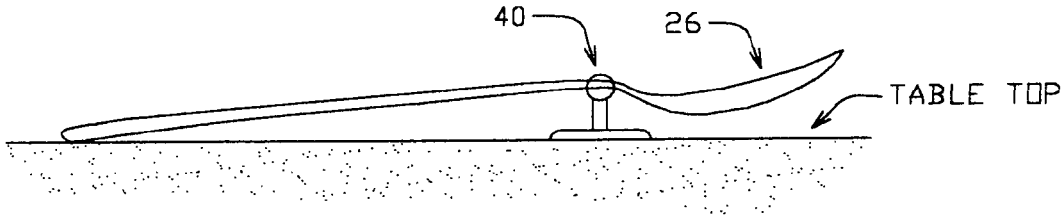
FIGS. 20-22 show end views of the device of FIGS. 16-19 in the three support configurations allowed for utensils (only spoon shown)
Figure 21:
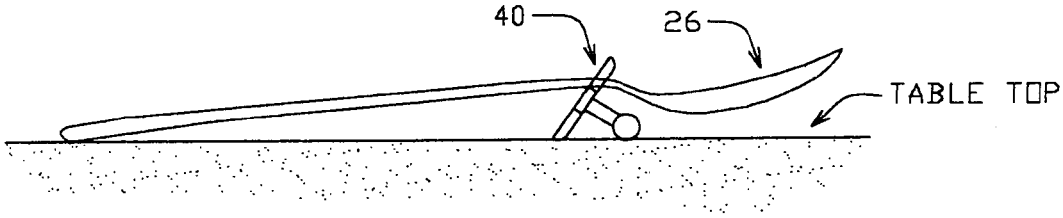
Figure 22:
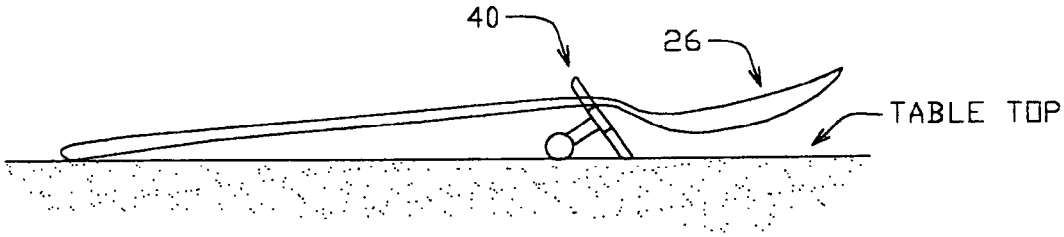
Figure 23:
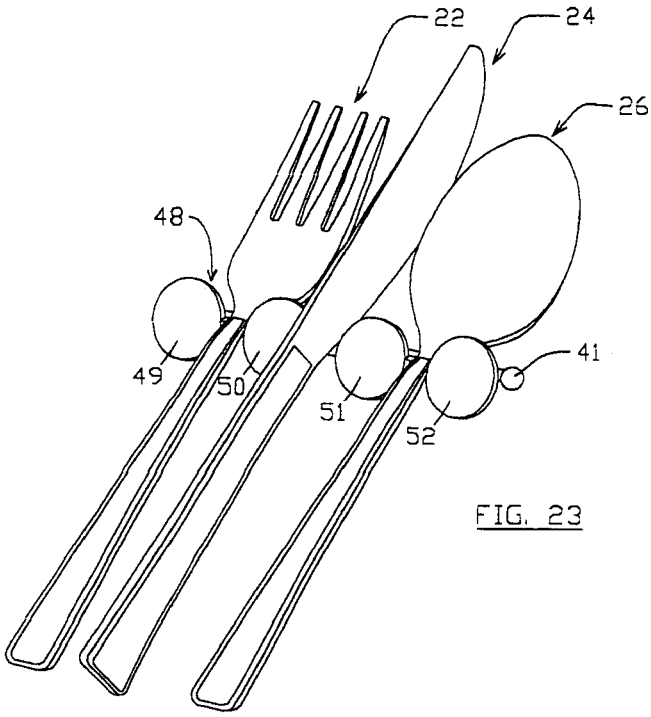
FIG. 23 is a perspective view similar to FIG. 21 with the invented device supporting a fork, knife, and spoon.
Figure 24:
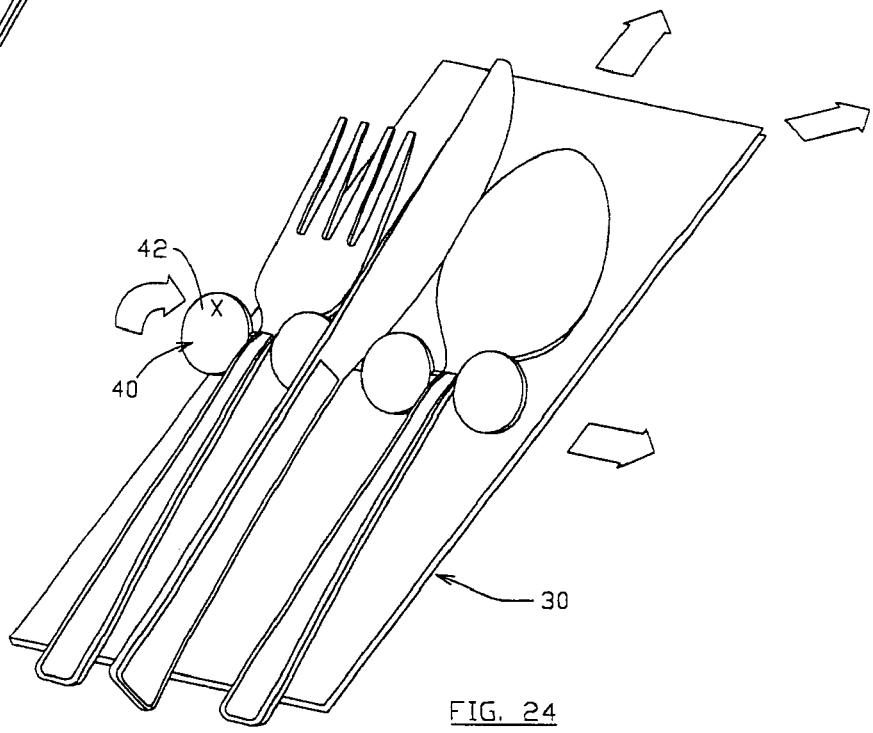
FIG. 24 shows FIG. 23 with a napkin (paper or cloth) inserted.

With reference to FIGS. 16-24 there is shown another embodiment of the invention. FIG. 16 shows device or clip 40 comprised of an upper arm 44, a bridge portion 48, and a base 42 having a bottom 9. The distal end of arm 44 preferably terminates in a round sphere or knob 41 while the proximal end of arm 44 preferably joins bridge portion 48 with round sphere or knob 45. The spheres 41, 45 provide raised lips at the end of arm 44 to prevent utensils from sliding off when device 40 is in the upright or standard or first orientation as shown in FIG. 20. Base 42 is comprised of a series of four enlarged portions 49, 50, 51, 52 which are connected via necks or neck portions 53, 54, 55. Each neck, such as neck 53, forms a recess or notch which can hold or retain a utensil as illustrated in FIGS. 21-24 when device 40 is in a tipped over or second orientation; the second orientation may be more stable than the first orientation. As shown in FIG. 23, fork 22 is held in the notch formed by neck 53; knife 24 is held in the notch formed by neck 54; and spoon 26 is held in the notch formed by neck 55. When held in a notch the eating utensil is more secure. FIGS. 21-24 show device 40 tipped over onto the upper arm 44. With reference to FIG. 23, the knife 24 is shown to be supported in a relatively vertical position, however, neck 54 can be made longer so that the knife 24 can also lie flat, or with a very short neck 54 the knife 24 can be positioned substantially vertical. FIG. 24 illustrates device 40 with a paper (can also be cloth) napkin 30 inserted below base 42 and above arm 44; see also FIG. 15. Of course napkin 30 can be inserted in FIG. 20 in the gap between arm 44 and base 42. The difference in FIG. 24 is that clip 40 in the illustrated position actually holds the napkin against the table—a useful function when considering an outdoor setting when wind can play a role in blowing napkins off tables. This configuration still allows for the napkin to be removed with relative ease by applying force at point X with one's left hand (as indicated by the arrow) in order to rotate clip 40 about the axis created by arm 44's contact with the table. This will, in effect, release the napkin from below and allow the user to remove it (as the other arrows again illustrate) without removing the supported eating utensils.

With reference to device 10 and device 40, the base, such as base 42 and the base defined by elements 12, 20 and 16, the base must be wide enough to prevent the device from tipping over and the upper arm is located (in top view) preferably between the front and the back of the base. But the upper arm and base can have non-uniform cross-sections and designs. Optionally the upper arm can be inserted inside the napkin roll, leaving the base on the outside of the napkin roll.

Figure 25:
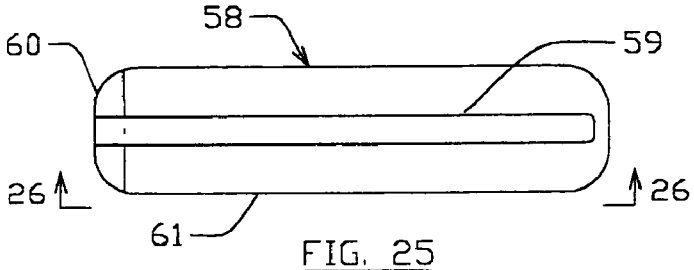
FIG. 25 is a top or plan view of an alternative embodiment of the invention.
Figure 27:
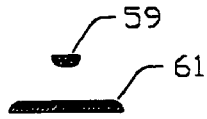
FIG. 27 is a cross-sectional view taken along line 27-27 of FIG. 26.
Figure 26:
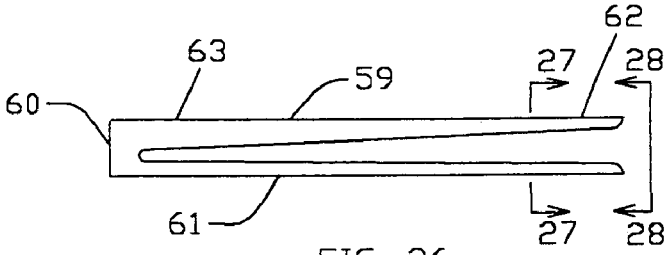
FIG. 26 is a front or elevational view of the device of FIG. 25.
Figure 28:
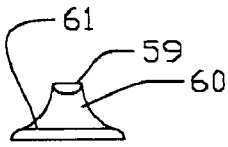
FIG. 28 is an end view taken along line 28-28 of FIG. 26.
Figure 29:
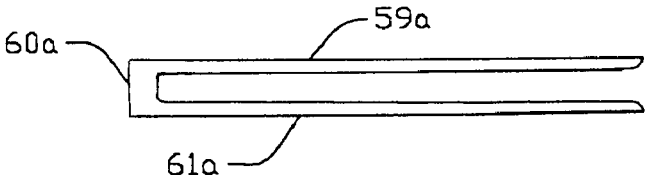
FIG. 29 is a front or elevational view of an alternative embodiment similar to FIG. 26.
Figure 30:
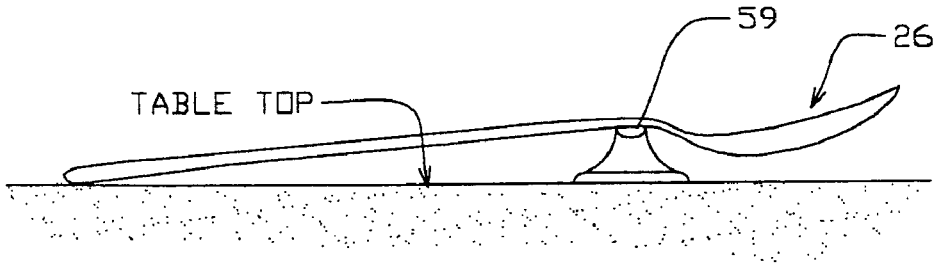
FIG. 30 is a side view similar to FIG. 7 but with the device of FIG. 25.
Figure 27A:
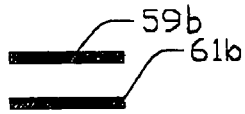
FIG. 27*a* is a cross-sectional view the same as FIG. 27 except showing an alternative embodiment of the invention.
Figure 27B:
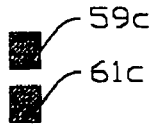
FIG. 27*b* is a cross-sectional view the same as FIG. 27*a* except showing an alternative embodiment of the invention.

With reference to FIGS. 25-28 there is shown another embodiment of the invention. FIG. 25 shows device or clip 58 comprised of an upper arm 59, a bridge portion 60, and a base 61, the bridge portion 60 connecting arm 59 and base 61. Base 61 is shown as a monolithic substrate with a solid substantially rectangular surface. With reference to FIG. 26 there is a gap between upper arm 59 and base 61, with the gap being wider at the distal end of arm 59 and narrower at the proximal end of arm 59. At location 62, upper arm 59 is 1 to 2 to 3 mm thick (from top surface to bottom surface) and at location 63, arm 59 is about 2, 3, 4, 5 or 6 times thicker, such as 4, 5, 6, 7, 8, 9, 10 or 11 mm thick. (The gap can alternatively be made narrower by thickening base 61 as it approaches bridge portion 60). A gap that gets narrower as it approaches the bridge portion 60 is better able to grip or hold the napkin inserted therein. FIG. 29 is the same as FIG. 26 except it shows that the gap in any of the embodiments of the invention can be of constant width from proximal to distal ends of arm 59*a*. If the gap is of uniform width or thickness, it is preferably 2-20, 5-15, 7-13, 9-11, about 10, mm wide. If the gap gets narrower, preferably it narrows from 12, 14, 16, 18 or 20 mm wide to about 2, 3 or 4 mm wide. FIG. 30 shows spoon 26 resting on arm 59 of device 58. FIG. 27 shows that arm 59 is much narrower in cross-section than base 61. FIG. 27*a* is the same as FIG. 27, except it shows that upper arm 59*b* can be much wider, such as it can be as wide as base 61*b*. FIG. 27*b* is the same as FIG. 27*a*, except it shows that upper arm 59*c* can be the same rectangular cross-section as base 61*c*. The structure of FIG. 27*b* can be rotated ninety degrees so that arm 59*c* and base 61*c* are side-by-side rather than one on top the other; the utensil can then be supported by 59*c* and 61*c* at the same time.

With reference to devices 10, 40, 58 and 66, the upper arm is preferably as long as the base; the upper arm and the base are each preferably at least 1 inch long, preferably 1-8, 1-6, 2-5, 2-4, 3-4, 2.5-3.5, 2.5-3, about 3, inches long. Also, bridge portion 18 doesn't have to be at the end of arm 14, it can be a short or long distance in from the end of arm 14, such as 1 inch in from the end. The upper arm is preferably 2-5 mm wide and 2-3 mm thick or as thick as the base; optionally the upper arm can be as wide as the base, but preferably not wider, which could lead to instability. The upper arm can be flattened wire. The width of the base (from front edge or points to back edge or points to prevent it from tipping over) is preferably, ¼-2, ⅜-1½, ½-1¼, ¾-1⅛, ⅞-1⅛, about 1, inches. The width of the base is determined by comparing and considering the front points and back points of the base which prevent it from tipping over. The base is preferably 1/32-¼, about ⅛, inches thick or as thick as the upper arm. The total height, from the bottom of the base to the top of the central portion of the upper arm, is preferably ¼-2, ¼-1, ½-1, ¼-¾, ⅜-⅝, about ½, inch.

Figure 31:
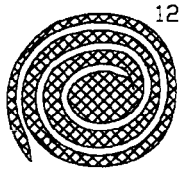
FIG. 31 is a cross-sectional view taken along line 31-31 of FIG. 6 but with the invented device and utensils omitted.
Figure 32:
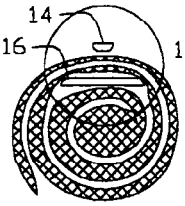
FIG. 32 is a cross-sectional view taken along line 31-31 of FIG. 6 but with the utensils omitted.
Figure 33:
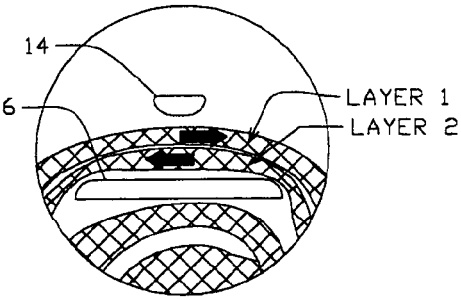
FIG. 33 is a close-up view of the circled portion of FIG. 32 showing the frictional forces between napkin layers.

FIG. 31 shows a cross-sectional view of a typical napkin roll where utensils might lie within. For illustrative purposes, a gap is shown between layers throughout the roll. FIG. 32 illustrates device or clip 10 as it would be applied to the napkin roll with the base comprised of 12, 20, 16 located interiorly and arm 14 located exteriorly. Within the gap between base 12, 20, 16 and arm 14 are shown multiple layers, in this case two, in the close-up view of FIG. 33. Note that clip 10 comprises a base that is placed within the rolls of a napkin, and an element (arm 14) that remains outside the napkin. The interior element can allow for the napkin roll to become tighter than it was before the element was inserted, while the exterior element can help prevent the napkin roll from unraveling. The upper arm and the base are only attached at one end. The free end is required in order for clip 10 to be inserted into an already rolled napkin. Note that the gap between the upper arm and the base continues through the majority of clip 10's cross-section. This gap is useful for clip 10 to be applied to a napkin roll and removed with relative ease. The element of clip 10 that is inside the napkin roll is in effect forcing the rolls it is placed beneath to expand, while the friction among the napkin layers acts to oppose this force, in conjunction with the exterior element of clip 10 (See FIG. 33). The exterior element (for example arm 14), in many cases may not even be in substantial contact with the napkin layers—instead, it can serve to help prevent the napkin roll from unraveling and therefore loosening itself. This creates a package effect, which enables the napkin/utensil/clip 10 package to be handled easily without the utensils falling out of the roll or without the napkin unraveling. This can be very advantageous in restaurants where the speed of packaging the utensils and setting them in place is of importance and, in other cases, when small children are not wanted to tamper with the silverware, especially the knives. It creates a compact, simple, and elegant package.

Figure 34:
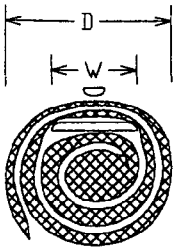
FIG. 34 shows FIG. 32 with designated dimensions for discussion purposes.
Figure 35:
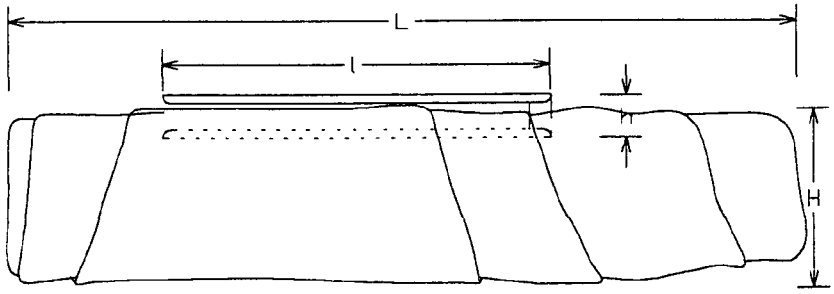
FIG. 35 shows FIG. 10 with designated dimensions for discussion purposes.
Figure 36:
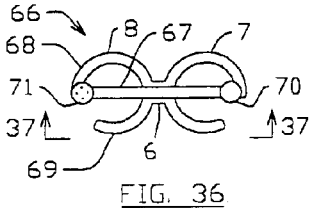
FIG. 36 is a top or plan view of another embodiment of the invention.
Figure 38:
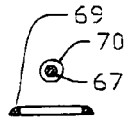
FIG. 38 is a cross-sectional view taken along line 38-38 of FIG. 37.
Figure 37:
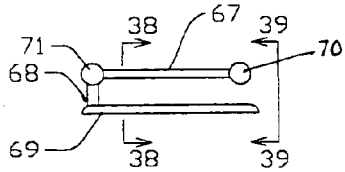
FIG. 37 is a front or elevational view of the device of FIG. 36 taken along line 37-37 of FIG. 36.
Figure 39:
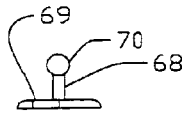
FIG. 39 is an end view taken along line 39-39 of FIG. 37.

FIG. 34 and FIG. 35 illustrate preferred overall dimensions of clip 10. The width of the base of clip 10 is limited to the overall width of the napkin or napkin/utensil package, usually about 2". FIG. 35 shows the length of clip 10 with respect to the overall length of the napkin/utensil package. As shown, the overall length of a preferred embodiment of clip 10 is less than the overall length of the napkin/utensil package, and can be approximately half or preferably 3.5 to 4 inches. The length might also depend on the number of utensils clip 10 would be supporting (very short or 1" for one utensil, or very long (over 4") for 3 or more utensils. The overall height of clip 10 is shown to be just a fraction of the overall height of the napkin roll. In the embodiments discussed, the overall height can be about ½" to 1", with respect to the napkin/utensil roll which is approximately 2".

Figure 40:
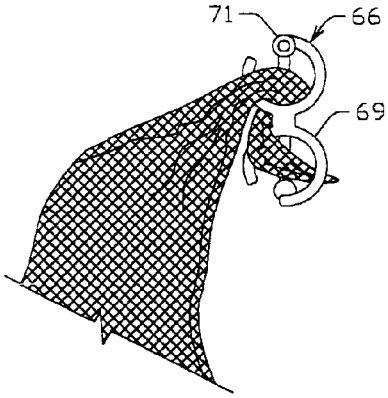
FIG. 40 is a perspective view of the device of FIGS. 36-39 showing the path of a napkin through the clip when used as a bib clip.
Figure 41:
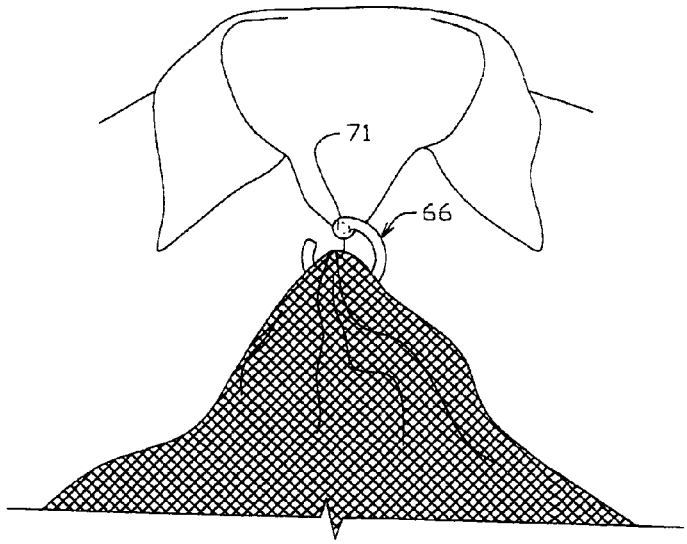
FIG. 41 is a perspective view showing the device of FIG. 36 when inserted into a typical shirt collar with napkin attached.

FIGS. 36-41 illustrate another embodiment of the invention. FIGS. 36-39 show invented device or clip 66, which, in addition to functioning as a napkin clip and utensil support as per the above descriptions, extends its uses to include that of a napkin or bib clip. Device 66 comprises an upper arm 67, a bridge portion 68, and a base 69. Base 69 is comprised of a pair of unclosed arcuate elements 7, 8, which are joined together via neck 6. The arcuate elements are unclosed so the napkin can be threaded therethrough. Alternatively base 69 can be shaped like an "S" with arm 67 extending from the top of the S to the bottom. Alternatively elements 7 and 8 can be rectangular or square or circular, and closed rather than unclosed. The distal end of arm 67 terminates in sphere or knob 70; arm 67 joins bridge portion 68 at sphere or knob 71. Once removed from the napkin/utensil package, clip 66 can receive a corner of the napkin in order to attach clip 66 and the napkin to the patron's collar as illustrated in FIGS. 40-41. This is a common practice made easier with clip 66 since the patron doesn't have to stuff the napkin into his/her collar. Clip 66 can be inserted into the collar, necktie, or between buttons in a button-down shirt or blouse. It can also be easily removed once the patron excuses themselves from the table. This design will be especially useful to anyone concerned about staining his or her own clothing, or for very young kids (ages 3 and below) that would normally use one utensil such as a spoon or fork (or spork). Additional methods of attaching or entwining the napkin to clip 66 are available.

Figure 42:
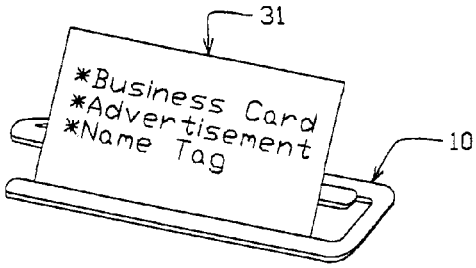
FIG. 42 is a perspective view showing the device of FIG. 1 with a business card.
Figure 44:
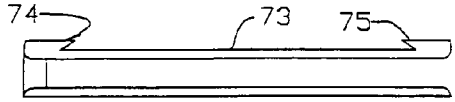
FIG. 44 is a front or elevational view of an alternative embodiment of the invention.
Figure 46:
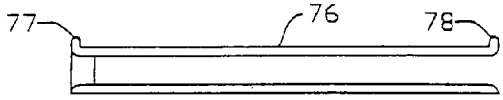
FIG. 46 is a front or elevational view of an alternative embodiment of the invention.
Figure 47:
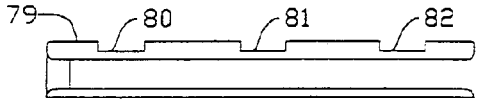
FIG. 47 is a front or elevational view of an alternative embodiment of the invention.
Figure 43:
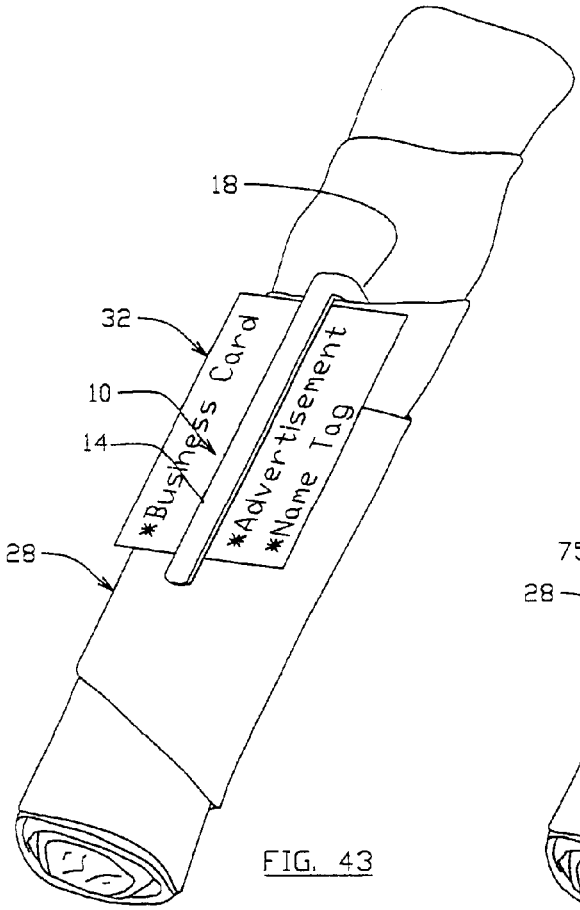
FIG. 43 is a perspective view showing the elements of FIG. 9 with a business card.
Figure 45:
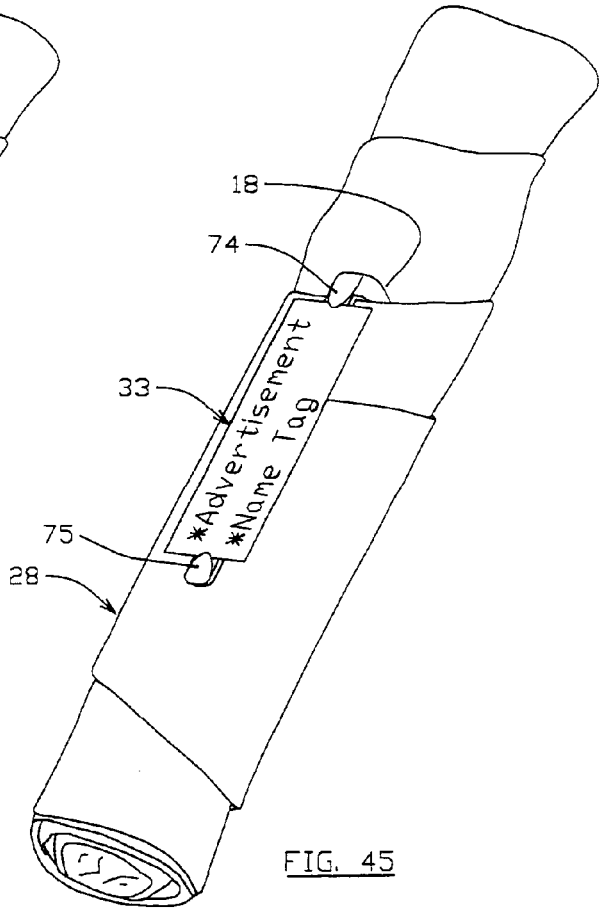
FIG. 45 is a perspective view showing the device of FIG. 44 in use.

FIGS. 42-43 illustrate clip 10 being used to display a business card, name tag or advertisement. For example, in FIG. 42 a business card 31 has been placed relatively upright within clip 10 while no utensils are being supported. FIG. 43 shows a name tag 32 inserted between arm 14 of clip 10 and the napkin roll. FIG. 44 shows a front or elevational view of another embodiment of the invention which is the same as FIG. 2, except that the upper arm 73 of the device or clip has holding tabs 74, 75 which can hold a business card, name tag 33, advertisement, etc. as shown in FIG. 45. FIG. 46 is the same as FIG. 2, except that the upper arm 76 has upstanding lips 77, 78 at the ends of arm 76 to keep the utensils from sliding off. FIG. 47 is the same as FIG. 2, except that upper arm 79 has notches or recesses 80, 81, 82 to help hold the utensils in place.

In all of the illustrated embodiments of the invention, each base and each upper arm have a longitudinal axis running lengthwise, and the longitudinal axes of the base and upper arm of each device are substantially parallel, even in FIG. 26, where the variable gap is not considered in determining the longitudinal axes.

Clip 10 also lends itself to creativity, in that it (or upper arm 14) can be formed to resemble a long slender fish or anchor (such as for seafood restaurants), or flower stems, a slender reclining lady, company logos or trademarks, etc.

Upper arm 14 can be cast to resemble a long slender fish, anchor, or fishing rod for seafood-type restaurants, or baseball bats or skis for sportsmen, flower stems, or company logos and trademarks, etc.

Although the preferred embodiments of the invention have been shown and described, it should be understood that various modifications, changes and rearrangements may be resorted to without departing from the scope of the invention as disclosed and claimed herein.

What is claimed is:

1. A device for use as a napkin clip and utensil rest, said device comprising a base having a longitudinal axis and an upper arm having a longitudinal axis, said base having a bottom which substantially defines a plane so that said bottom is capable of being rested on a flat surface, said base including a connected leg, a second leg and a base leg connector, said connected leg being joined to said second leg by said base leg connector, said connected leg having a longitudinal axis which is substantially parallel to a longitudinal axis of said second leg, said upper arm having a distal end and a proximal end, said distal end being a free end, said proximal end being joined to said connected leg by a bridge portion, the upper arm being substantially parallel with said plane, the longitudinal axis of the base being substantially parallel with the longitudinal axis of the upper arm, said base and upper arm defining a gap therebetween effective to accommodate a napkin, said upper arm being spaced apart from said plane so as to define said gap, said gap extending to said distal free end.

2. The device of claim 1, wherein said base extends from said bridge portion a distance of 1 to 6 inches.

3. The device of claim 2, wherein said upper arm extends from said bridge portion a distance of 1 to 6 inches.

4. The device of claim 3, wherein said base has a width of ¼ to 2 inches.

5. The device of claim 4, wherein a height of the device from the bottom of the base to the top of the central portion of the upper arm, is ¼ to 2 inches.

6. The device of claim 5 wherein the gap is 2 to 20 mm.

7. The device of claim 5, wherein said base comprises a plurality of enlarged portions connected by narrower neck portions.

8. The device of claim 7, wherein, when said device is tipped over onto the upper arm, each neck portion forms a recess which can support a portion of a utensil off a table top.

9. The device of claim 5, wherein said gap is wider at the upper arm distal end than at the upper arm proximal end.

10. The device of claim 5, wherein said gap is of substantially constant width.

11. The device of claim 5, wherein said upper arm has a pair of spaced apart upstanding lips.

12. The device of claim 5, wherein said upper arm has a pair of spaced apart holding tabs.

13. The device of claim 5, wherein said upper arm has a plurality of notches.

14. A method of providing a napkin and one or more eating utensils for a meal, said napkin comprising a layer of material, said method comprising the steps of: providing said napkin rolled up around one or more eating utensils selected from the group consisting of a knife, a fork, a spoon, and chopsticks; providing a device according to claim 1; and clipping said device to said rolled up napkin.

15. The method of claim 14, further including a step of removing said device from said rolled up napkin, removing said one or more eating utensils from said napkin, and supporting at least one of said eating utensils on said device so that said device acts as a utensil rest.

* * * * *